US012630347B2

(12) United States Patent
Dang

(10) Patent No.: US 12,630,347 B2
(45) Date of Patent: May 19, 2026

(54) OPENING FOR A BLISTER PACKAGE

(71) Applicant: Kenvue Brands LLC, Summit, NJ (US)

(72) Inventor: Thien Dang, Phoenixville, PA (US)

(73) Assignee: Kenvue Brands LLC, Summit, NJ (US)

( * ) Notice: Subject to any disclaimer, the term of this patent is extended or adjusted under 35 U.S.C. 154(b) by 43 days.

(21) Appl. No.: 18/642,137

(22) Filed: Apr. 22, 2024

(65) Prior Publication Data

US 2025/0108969 A1 Apr. 3, 2025

Related U.S. Application Data

(60) Provisional application No. 63/586,466, filed on Sep. 29, 2023.

(51) Int. Cl.
*B65D 75/32* (2006.01)

(52) U.S. Cl.
CPC ..... *B65D 75/327* (2013.01); *B65D 2215/04* (2013.01); *B65D 2575/3227* (2013.01)

(58) Field of Classification Search
CPC ..... B65D 2575/3227; B65D 2215/04; B65D 75/327
USPC ..... 206/534.1, 534.2, 532, 531
See application file for complete search history.

(56) References Cited

U.S. PATENT DOCUMENTS 5,551,567 A * 9/1996 Malone ..... B65D 75/327 206/532
5,862,915 A 1/1999 Plezia et al.
6,352,158 B1 * 3/2002 Cole-Bennett ..... B65D 75/327 206/532
6,422,391 B1 7/2002 Swartz
7,866,474 B2 * 1/2011 Geser ..... B65D 75/327 206/532
7,866,475 B2 * 1/2011 Doskoczynski ..... B65D 75/366 206/532
2006/0249422 A1 11/2006 Bates, Jr.
2016/0143808 A1 * 5/2016 Pattison ..... B65D 17/4011 53/410

(Continued)

FOREIGN PATENT DOCUMENTS

WO 2006/023643 A2 3/2006

OTHER PUBLICATIONS

International Search Report and Written Opinion, mailed Sep. 9, 2024, for international application PCT/IB2024/054528.

*Primary Examiner* — Chun Hoi Cheung

(57) ABSTRACT

An improved notch-forming tab enables a blister card package comprising a medicament to be easily opened by a user. The blister card package includes a container sheet having a well formed therein; a cover sheet laminated to the container sheet and spanning the well to form a blister containing the medicament between the cover sheet and the container sheet; and a plurality of slits defining a pattern comprising a pair of legs having respective converging and diverging ends disposed adjacent the blister. The converging ends of the pair of legs are separated from one another by between about 0.1 mm and about 1 mm and are spaced from the blister. The diverging ends of the pair of legs are spaced from an adjacent edge of the blister pack. Methods of opening this and other inventive blister card packages are also described herein.

18 Claims, 7 Drawing Sheets

(56) References Cited

U.S. PATENT DOCUMENTS

| | | | | |
|---|---|---|---|---|
| 2018/0153769 | A1* | 6/2018 | Dey | B65D 75/327 |
| 2024/0082107 | A1* | 3/2024 | Laugros | B65D 75/327 |

* cited by examiner

OPENING FOR A BLISTER PACKAGE

PRIORITY CLAIM

The present application claims priority to U.S. Provisional Application Ser. No. 63/586,466 filed Sep. 29, 2023, the entire contents of which is hereby incorporated by reference herein.

FIELD OF THE INVENTION

The present invention relates generally to packaging for medications that is simultaneously easy to open by adult users but difficult to open by children. More specifically, this invention relates to the configuration of the opening in a blister card package and the method by which adult users gains access to the medicaments.

BACKGROUND OF THE INVENTION

Blister card packages are one form of container commonly used for the packaging of medicaments, particularly for unit-dose packaging where the delivery of individually packaged dosage units to the consumer or patient is desirable. A suitable blister card package provides a container for the delivery of solid medicaments that is tamper-evident, airtight, uses conventional materials and equipment to produce and is thus economical.

Generally, a conventional blister card package provides a container for individual dosages of the medicament separately packaged for delivery of the individual dosage to a patient. Typically, a blister card package contains a number (usually about 6-8) of individual dosages on a card where each dosage is separately contained and can be separated by perforations such that it can be readily detached. The blister card package is usually constructed of several layers. The bottom layer is a container sheet or container formstock constructed of a relatively rigid material having integrally formed cavities or wells designed to hold an individual dosage unit. The container sheet is sealed to a covering material or sheet (sometimes described as lidstock), and is often constructed of a foil and paper laminate. The blister package can be designed for removal of the dosage form from the container in a variety of ways. In some packages, the dosage is removed by pressing it through the closure sheet, where the closure sheet is made from a rupturable material. In other designs, the closure sheet is designed to be peeled off from the container sheet to remove the dosage form. Alternatively, the blister is scored to form a weakened area enabling the user to tear the blister and expose the cavity containing the tablet.

In designing a suitable blister card package, it is desirable that the package be tamper resistant and airtight but be easily opened by adults. At the same time, it is often desirable (and in some jurisdictions a legal requirement) that the package be child-resistant and not easily opened by children. A problem with many conventional blister packages is that they are too difficult to open, particularly by seniors or others with impaired dexterity but even by a healthy adult. In a rupturable package, the tablet or capsule may be damaged during opening. In a peel-apart package, the layers can be difficult to manipulate and separate because the layers are thin and tightly sealed.

Plezia et al., U.S. Pat. No. 5,862,915, describes a child resistant and easy to use blister package for containing a solid medicament that utilizes a dual compartment cavity assist mechanism as an opening feature. The multi-section blister card package comprises a rigid container sheet with cavities for containing the product such as a solid dosage form medicament, and a backing closure sheet sealed to the container sheet and covering the product cavities. The opening feature is accomplished using a pre-formed dual compartment cavity in the blister container sheet which is adjacent to the cavity containing the product and a corresponding weakened area such as perforation or score in the backing closure sheet in the area covering the dual compartment cavity. The blister is opened by applying pressure on the dual compartment cavity at the underside of the backing score line. The pre-formed second cavity assists in forming a pull tab on the opposite side of the blister, allowing for easy access to separate and pull the backing material towards the product cavity and thus exposing the product cavity for product removal. The dual compartment feature of the pre-formed second cavity does not require the consumer to physically invert or deform the thermoformed container sheet at the second cavity. The ridge created by the dual compartment gives the user leverage by concentrating the pushing force to the perforated or scored line of the backing closure sheet. While effective for its intended purpose and a significant advancement in the art, the dual compartment feature may result in a relatively costly manufacturing process and the use of more plastic formstock than in single compartment blister packs.

Swartz, U.S. Pat. No. 6,422,391 purports to describe a blister pack with a die cut slit on the lidstock to enable an adult user to tear open the blister pack. The drawings show a die cut tab defined by a generally V-shaped notch formed with the apex of the notch directed toward the medicament and which can be deflected from the plane of the blister pack and removed to define the spaced-apart legs subsequently employed for the opening of the blister pack. The legs are torn apart typically by tearing in a direction opposite the plane of the blister pack for severing the film blister over the area of the medicament for gaining access to the medicament. Still, improvements in the configuration of the die cut slit are desirable to further facilitate opening on the blister packages by adult populations while maintaining child resistance.

Thus, there continues to be a need for a blister card package design which allows easy access by adults, including seniors, yet passes child resistant testing. There is also a need for a blister card package which meets these requirements, and which utilizes conventional materials.

SUMMARY OF THE INVENTION

In one aspect of the present invention, I have found an improved notch-forming tab that enables a blister card package comprising a medicament to be easily opened by a user. The blister card package includes a container sheet having a well formed therein; a cover sheet laminated to the container sheet and spanning the well to form a blister containing the medicament between the cover sheet and the container sheet; and a plurality of slits defining a pattern comprising a pair of legs having respective converging and diverging ends disposed adjacent the blister. The converging ends of the pair of legs are separated from one another by between about 0.1 mm and about 1 mm and are spaced from the blister. The diverging ends of the pair of legs are spaced from an adjacent edge of the blister pack.

In another aspect of the invention an improved blister card package for a medicament comprising a plurality dosing units separated by at least one line of weakness. Each dosing unit includes a container sheet having a well formed therein;

a cover sheet laminated to the container sheet and spanning the well to form a blister containing a medicament between the cover sheet and the container sheet; and a plurality of slits defining a pattern comprising a pair of legs associated with the blister having respective converging and diverging ends disposed between the blister and a line of weakness. The converging ends of the pair of legs are separated from one another by between about 0.1 mm and about 1 mm and are spaced mm from the blister. The diverging ends of the pair of legs are spaced from an adjacent line of weakness.

In another aspect of the invention, a child-resistant blister card package for a medicament requires at least a two-step opening process. The child-resistant blister card package includes a container sheet having a well formed therein; a cover sheet laminated to the container sheet and spanning the well to form a blister containing a medicament between the cover sheet and the container sheet; and a plurality of slits defining a pattern comprising a pair of legs having respective converging and diverging ends disposed adjacent the blister. The converging ends of the pair of legs are separated from one another by between about 0.1 mm and about 1 mm and are spaced from the blister. The diverging ends of the pair of legs are spaced from an adjacent edge of the blister card package.

Additional aspects of my invention include methods of opening the blister card packages described above.

Further objects and advantages of the invention will be readily apparent to those skilled in the art from the following detailed description, taken in conjunction with the sheets of drawings.

BRIEF DESCRIPTION OF THE DRAWINGS

Embodiments of this invention will now be described in greater detail, by way of illustration only, with reference to the accompanying drawings, in which.

DETAILED DESCRIPTION OF THE INVENTION

Figure 1:
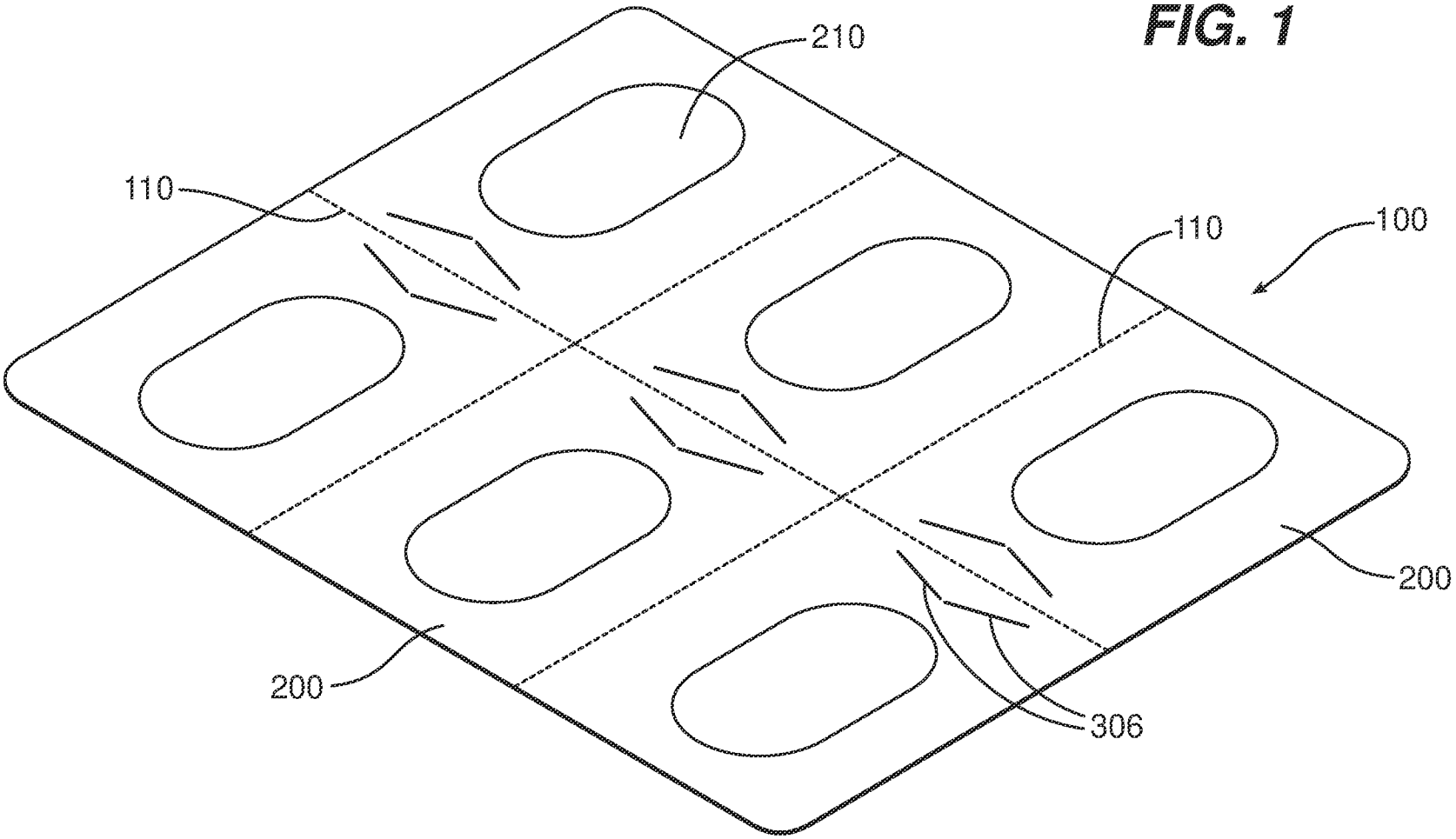
FIG. 1 is a perspective view of a blister card package according to an embodiment of the present invention.
Figure 2:
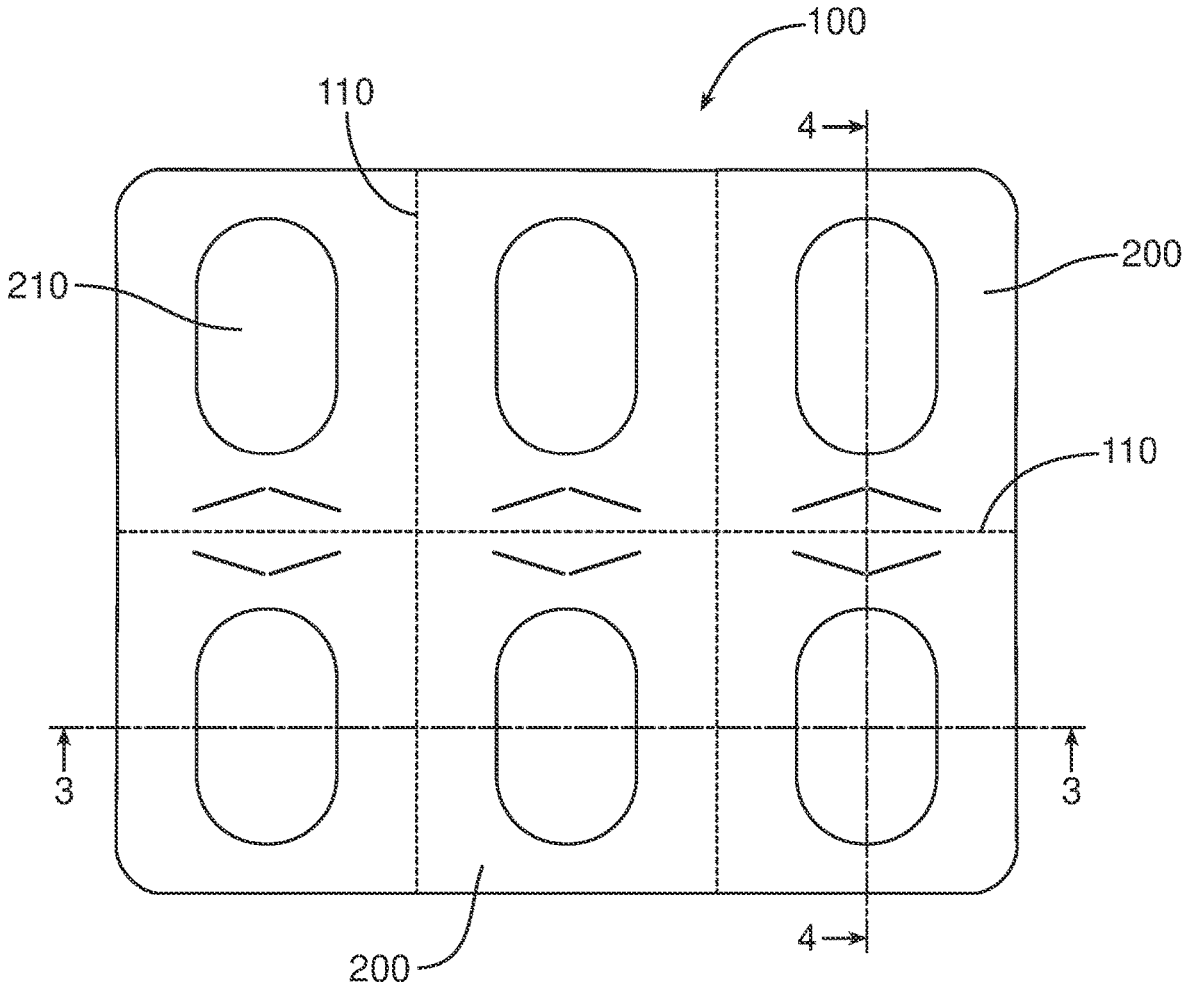
FIG. 2 is a top plan view of the blister card package of FIG. 1.

The inventive blister card package described herein can be seen in FIGS. 1 through 6. There is contained a blister card package 100 separated into individual dosage unit sections 200 which are separable from the remainder of the package 100 via score lines or perforations 110. Each individual dosage unit section 200 is provided with a blister 210 to accommodate a medicament 120 such as a tablet, capsule or the like. As shown in FIG. 1, blister card package 100 includes six individual dosage unit sections 200, although other alternate configurations are possible. For example, a blister card may be configured to contain between 1 and 12 sections, each containing an individual dosage unit. Other configurations may have 4-12 sections, or 6-8 sections.

Each of the individual dosage unit sections 200 may be detached from the blister card package 100 by bending and tearing along one or more lines of perforations 110, as known in the art.

Figure 3:
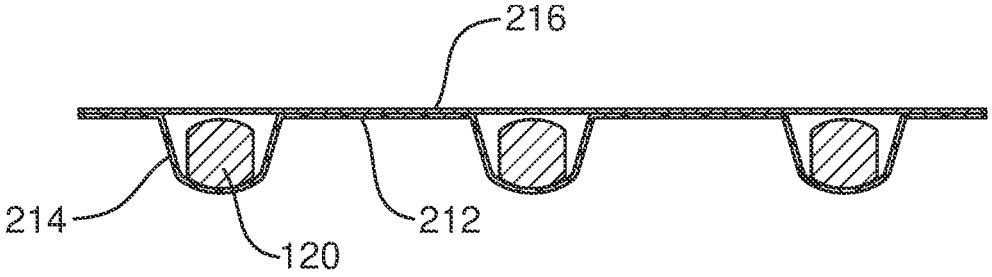
FIG. 3 is a cross-section along line 3-3 of the blister card package of FIG. 2.
Figure 4:
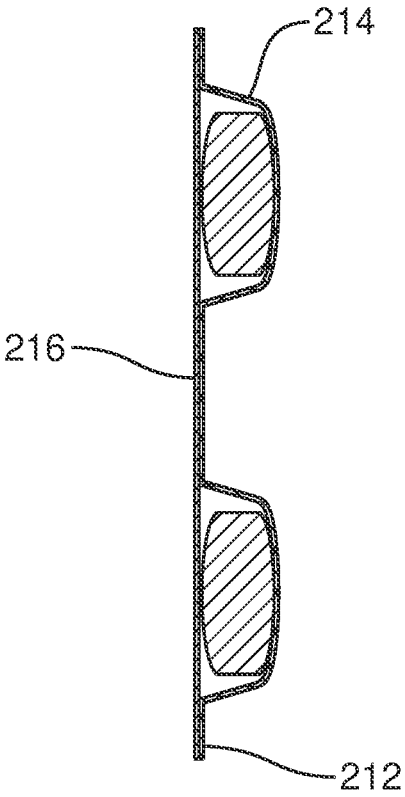
FIG. 4 is a cross-section along line 4-4 of the blister card package of FIG. 2.

The blister package 100 has at least two layers as shown in FIGS. 3 and 4. The first layer is a container sheet 212, preferably formed of a rigid, heat sealable material in which wells 214 may be formed. The second layer is a cover sheet 216 which is heat sealed to the container sheet 212. The cover sheet 216 completely overlays the container sheet 212 and is heat sealed or glued thereto to provide an airtight seal.

Both the container sheet layer 212 and the cover sheet layer 216 are formed from conventional materials.

The container sheet 212 is preferably formed of a strong, rigid polymeric material, such as transparent polyvinyl chloride, polyvinyl dichloride, polyethylene or polypropylene. The container sheet has a substantial thickness of up to about 0.64 mm (0.025 inch), more preferably about 0.25 mm (0.01 inch), to provide the needed rigidity and to protect the contents of the blisters form damage during shipping. The container sheet should have the required strength to prevent access by a child. The wells 214 are integrally formed in the container sheet 212 and have the desired configuration to contain the medicament 120 product.

The cover sheet 216 may be any material or laminate that effectively seals the medicament 120 in the well 214. One useful embodiment may be a laminate of thin metal foil such as aluminum foil and paper. However, to achieve child resistance, the laminate often includes a layer such as polyethylene terephthalate (PET). This layer provides tear resistance. Therefore, the cover sheet 216 is preferably a laminate including PET and may include foil and paper layers for moisture resistance and printability, respectively. Thus, child resistant laminates often have a foil layer, PET layer and paper layer with the foil layer being treated to provide a heat sealable surface to enable heat sealing to the container sheet 212. Often, the paper layer serves as the label for the blister card package.

Again, the container sheet 212 and the cover sheet 216 are typically sealed together by means of heat sealing or adhesives as known in the art.

Figure 5:
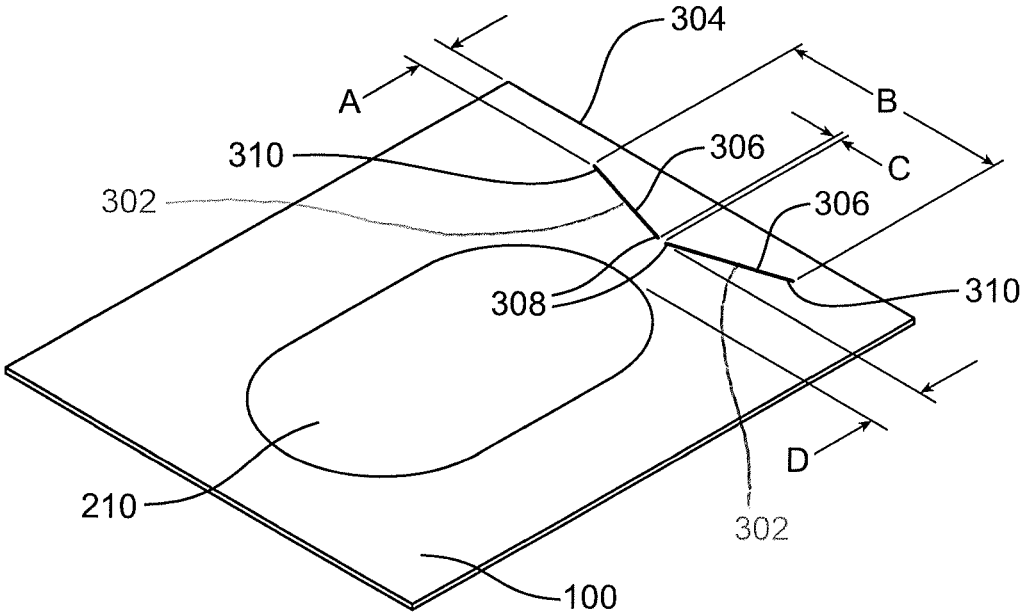
FIG. 5 is a perspective view of an individual dosage unit of a blister card packaging according to the present invention.

Referring now to FIG. 5, the blister card package 100 (or an individual dosage unit section 200) has an opening mechanism 300 defined by a plurality of slits 302 disposed between the blister 210 and an edge 304 of the blister card package 100 (or an individual dosage unit section 200). the plurality of slits 302 define a pattern including a pair of legs 306 having respective converging ends 308 and diverging ends 310. The converging ends 308 of the pair of legs 306 are disposed proximate the blister 210 and are separated from one another. The diverging ends 310 of the of the pair of legs 306 are disposed proximate the edge 304 and are separated from the edge 304.

The converging ends 308 are preferably separated from one another by about 0.1 mm to about 1 mm, more preferably by about 0.2 mm to about 0.8 mm (dimension "C" in FIG. 5). In addition, the converging ends 308 are preferably separated from the blister 210 by at least about 2 mm (dimension "D" in FIG. 5).

The diverging ends 310 are preferably separated from one another by about 10 mm to about 20 mm, more preferably by about 13 mm to about 17 mm (dimension "B" in FIG. 5).

In addition, the diverging ends 310 are preferably separated from the edge 304 by at least about 2 mm (dimension "A" in FIG. 5).

While legs 306 are shown as straight lines, it will be recognized that legs 306 may be other curvilinear forms, such as without limitation, concave or convex arcs, waves, and other forms.

Figure 6:
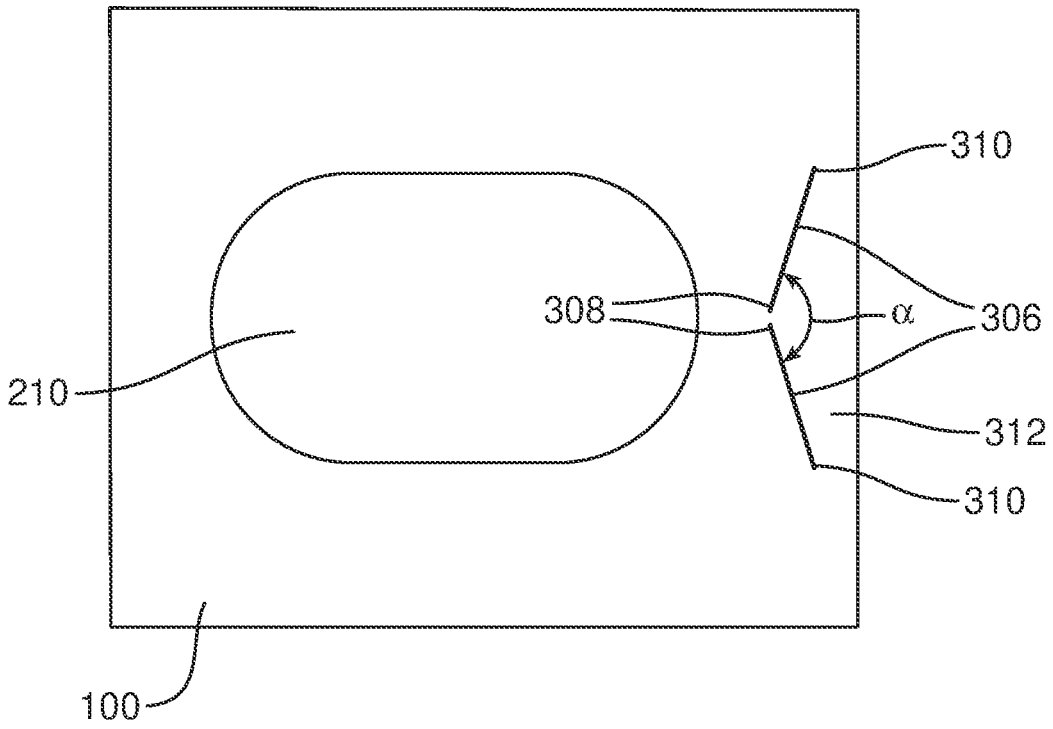
FIG. 6 is a top plan view of the dosage unit of FIG. 5.

In addition, the angle α defined legs 306 (defined by straight lines as shown in the drawings or defined by imaginary lines from their respective converging and diverging ends) is less than 180°, preferably an obtuse angle, and more preferably between about 90° and about 150°. (FIG. 6)

Figure 7:
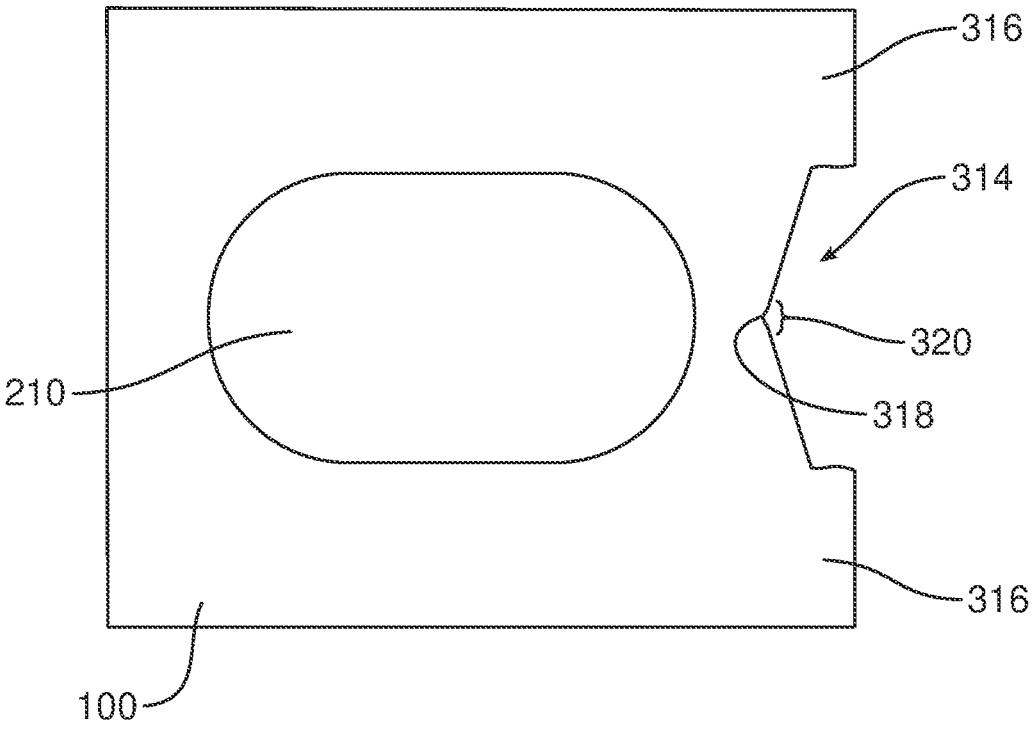
FIG. 7 is a top plan view of the dosage unit of FIG. 6 after removal of the tab.
Figure 8:
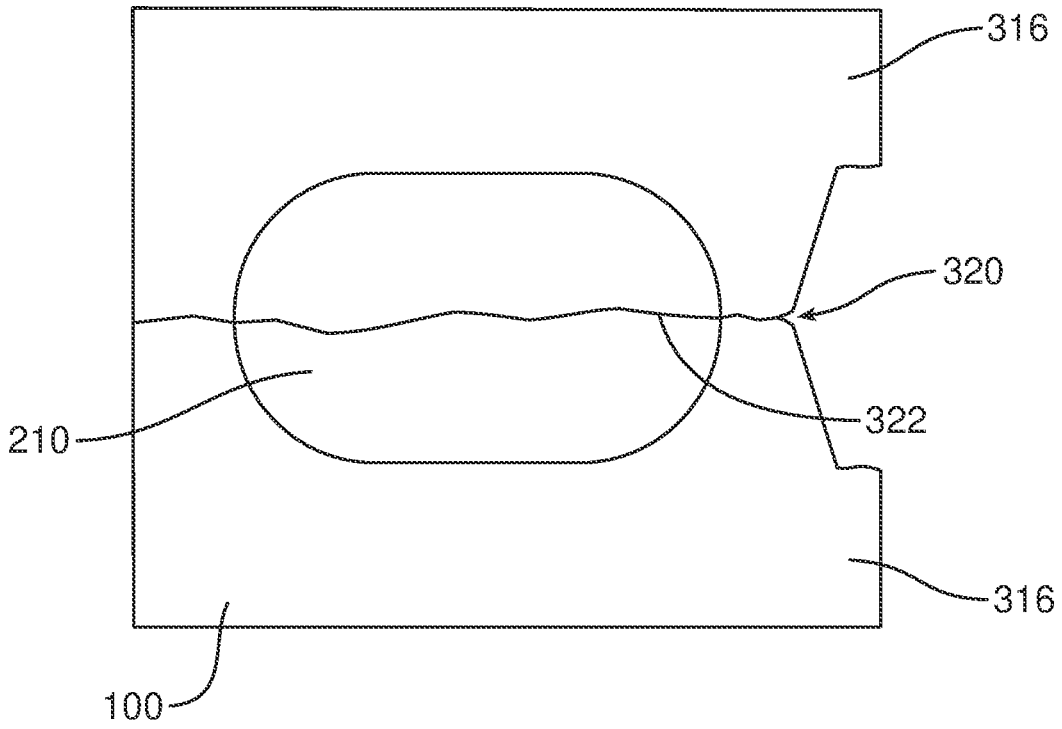
FIG. 8 is a top plan view of the dosage unit of FIG. 7 illustrating a fracture path of the blister card material enabling the removal of the medicament therefrom.

The opening of the blister card package 100 (or an individual dosage unit section 200) is a two-step process to increase child resistance including the steps of removing an inner tab 312 defined by the plurality of slits 302 including the pair of legs 306 having respective converging ends 308 and diverging ends 310. Again, the converging ends 308 of the pair of legs 306 are disposed proximate the blister 210 and are separated from one another. The diverging ends 310 of the of the pair of legs 306 are disposed proximate the edge 304 and are separated from the edge 304. The method described herein can be further understood by reference to FIGS. 6 through 8.

First, the inner tab 312 is grasped and twisted to fracture the laminate between the converging ends 308 of the pair of legs 306 and between each the diverging ends 310 of the pair of legs 306 and the edge of the blister pack 304. The inner tab 312 is manipulated (e.g., by twisting or otherwise flexing or distorting the blister card) to fracture the laminate between the converging ends 308 of the pair of legs 306 and between each the diverging ends 310 of the pair of legs 306 and the edge 304 of the blister card package 100 (or an individual dosage unit section 200). The removing the inner tab 312 to form a notch 314 between a pair of outer tabs 316, the notch 314 having an apex 318 defined by a fracture propagation region 320 formed between the converging ends 308 of the pair of legs 306. The outer tabs 316 are moved in opposite directions to fracture the laminate (e.g., along a tear 322) from the fracture propagation region 320 and toward and into the blister 210 to access the medicament 120 contained therein.

For a blister card package having a plurality of individual dosing units, a user would separate an individual dosing unit from the blister card packaging before completing the method described above.

Surprisingly, we have found that fracturing the laminate between the converging ends 308 provides improved opening performance, especially by adults with impaired strength, arthritic hands, or other conditions that impair the opening process described below. While not intending to be limited by this theory, we believe that the formation of the fracture propagation region reduces the force necessary to tear the laminate between the apex of the notch and the well in comparison to prior art blister card packages having a notch apex formed by a continuous slit, such as described in Swartz, U.S. Pat. No. 6,422,391.

What is claimed is:

1. A blister card package for a medicament comprising:

a) a container sheet having a well formed therein;

b) a cover sheet laminated to the container sheet and spanning the well to form a blister containing the medicament between the cover sheet and the container sheet; and c) a plurality of slits defining a pattern comprising a pair of legs having respective converging and diverging ends disposed adjacent the blister;

wherein the converging ends of the pair of legs are separated from one another by between about 0.1 mm and about 1 mm and spaced from the blister, and the diverging ends of the pair of legs are spaced from an adjacent edge of the blister pack.

2. The blister card package of claim 1 wherein the pair of legs is generally V-shaped having an apex directed toward the blister.

3. The blister card package of claim 1 wherein the pair of legs converge at an angle of from about 90° to about 150°.

4. The blister card package of claim 1 wherein the converging ends of the pair of legs are separated from one another by between about 0.2 mm and about 0.8 mm.

5. The blister card package of claim 1 wherein the diverging ends of the pair of legs are separated by between about 10 mm and about 20 mm.

6. A blister card package for a medicament comprising a plurality dosing units separated by at least one line of weakness, each dosing unit comprising:

a) a container sheet having a well formed therein;

b) a cover sheet laminated to the container sheet and spanning the well to form a blister containing a medicament between the cover sheet and the container sheet; and c) a plurality of slits defining a pattern comprising a pair of legs associated with the blister having respective converging and diverging ends disposed between the blister and the at least one line of weakness;

wherein the converging ends of the pair of legs are separated from one another by between about 0.1 mm and about 1 mm and spaced from the blister, and the diverging ends of the pair of legs are spaced from an adjacent line of weakness.

7. The blister card package of claim 6 wherein the pair of legs is generally V-shaped having an apex directed toward the blister.

8. The blister card package of claim 6 wherein the pair of legs converge at an angle of from about 90° to about 150°.

9. The blister card package of claim 6 wherein the converging ends of the pair of legs are separated from one another by between about 0.2 mm and about 0.8 mm.

10. The blister card package of claim 6 wherein the diverging ends of the pair of legs are separated by between about 10 mm and about 20 mm.

11. The blister card package of claim 6 comprising between 4 and 10 dosing units.

12. A child-resistant blister card package for a medicament requiring at least a two-step opening process, said blister card package comprising:

a) a container sheet having a well formed therein;

b) a cover sheet laminated to the container sheet and spanning the well to form a blister containing a medicament between the cover sheet and the container sheet; and c) a plurality of slits defining a pattern comprising a pair of legs having respective converging and diverging ends disposed adjacent the blister;

wherein the converging ends of the pair of legs are separated from one another by between about 0.1 mm and about 1 mm and spaced from the blister, and the diverging ends of the pair of legs are spaced from an adjacent edge of the blister card package.

13. The blister card package of claim 12 wherein the pair of legs is generally V-shaped having an apex directed toward the blister.

14. The blister card package of claim 12 wherein the pair of legs converge at an angle of from about 90° to about 150°.

15. The blister card package of claim 12 wherein the converging ends of the pair of legs are separated from one another by between about 0.2 mm and about 0.8 mm.

16. The blister card package of claim 12 wherein the diverging ends of the pair of legs are separated by between about 10 mm and about 20 mm.

17. A method of opening the blister card package of claim 1 comprising the steps of:

a) grasping an inner tab defined by the plurality of slits;

b) manipulating the inner tab to fracture the laminate between the converging ends of the pair of legs and between each the diverging ends of the pair of legs and the edge of the blister card package;

c) removing the tab to form a notch between a pair of outer tabs, the notch having an apex defined by a fracture propagation region formed between the converging ends of the pair of legs; and d) moving the outer tabs in opposite directions to fracture the laminate from the fracture propagation region and toward and into the blister to access the medicament contained therein.

18. A method of opening the blister card package of claim 6 comprising the steps of:

a) separating an individual dosing unit from the blister card package;

b) grasping an inner tab defined by the plurality of slits;

c) manipulating the inner tab to fracture the laminate between the converging ends of the pair of legs and between each the diverging ends of the pair of legs and the edge of the line of weakness;

d) removing the inner tab to form a notch between a pair of outer tabs, the notch having an apex defined by a fracture propagation region formed between the converging ends of the pair of legs; and e) moving the outer tabs in opposite directions to fracture the laminate from the fracture propagation region and toward and into the blister to access the medicament contained therein.

* * * * *